United States Patent [19]

Cartmill

[11] 4,019,489

[45] Apr. 26, 1977

[54] SAFETY APPARATUS FOR ENGINES

[76] Inventor: George Bowen Cartmill, 43 Conifer St., Alderley, Queensland 4051, Australia

[22] Filed: Dec. 8, 1975

[21] Appl. No.: 638,559

[30] Foreign Application Priority Data

Dec. 9, 1974 Australia ..... 9943/74

[52] U.S. Cl. ..... 123/198 D; 123/41.15

[51] Int. Cl.[2] ..... F02B 77/08

[58] Field of Search ... 123/198 D, 198 DB, 198 DC, 123/41.15

[56] References Cited

UNITED STATES PATENTS

| | | | |
|---|---|---|---|
| 2,210,044 | 8/1940 | Schirokauer | 123/198 DC |
| 3,601,103 | 8/1971 | Swiden | 123/198 DC X |
| 3,602,207 | 8/1971 | Kilmer | 123/198 D X |
| 3,763,397 | 10/1973 | Yockers | 123/198 D X |
| 3,841,291 | 10/1974 | Ludewig et al. | 123/198 D X |

*Primary Examiner*—C. J. Husar
*Assistant Examiner*—Ira S. Lazarus
*Attorney, Agent, or Firm*—DeLio and Montgomery

[57] ABSTRACT

A monitoring and control apparatus for an engine, particularly a water-cooled internal combustion marine engine, which includes devices for monitoring the temperature and/or flow of the coolant liquid and/or of the lubricant, the monitoring devices being included in an alarm system adapted to give visual and/or audible warning of an abnormal condition and to reduce automatically the speed of the engine, in order to prevent or minimize the danger of damage thereto.

11 Claims, 9 Drawing Figures

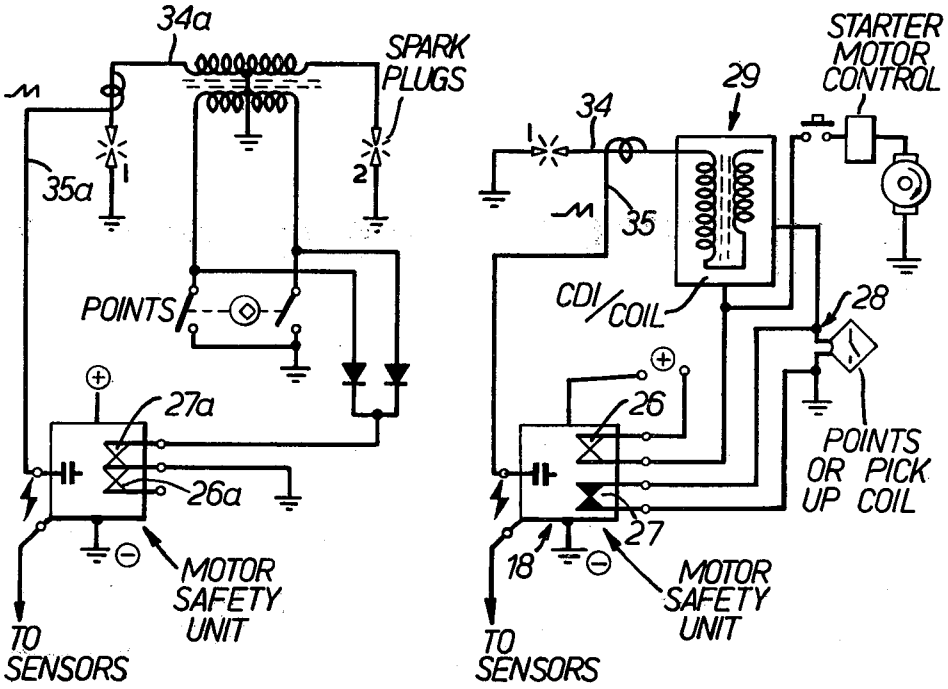
FIG. 7.
FIG. 8.
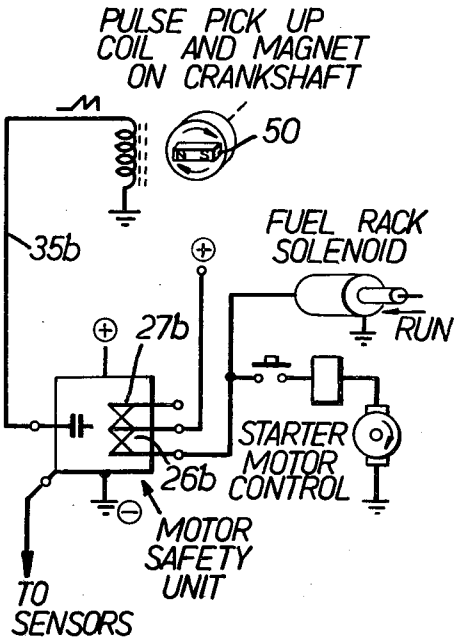
FIG. 9.

SAFETY APPARATUS FOR ENGINES

This invention relates to safety apparatus for engines and in particular for water-cooled engines.

Internal-combustion engines rely on a constant flow of service fluids and consumable fluids for continued operation, the service fluids such as cooling water and lubricating oils to maintain operating temperature of the engine at a safe level and the consumable fluid-fuel. If the flow of service fluids ceases, continued operation of the engine will cause the operating temperature of the engine to increase to a point where serious damage can be done to the engine. While such damage can be expensive to repair, in the case of an engine for a boat such damage can endanger the lives of the persons in the boat as will become apparent. Accordingly, the invention has been primarily devised as a safeguard device to prevent such damage to marine engines.

Marine engines, for example outboard motors, often pick up debris such as plastic bags and the like from the water where the inlet suction at their water intake grill causes the debris to adhere to the intake and cause instantaneous stoppage of the flow of cooling water into and through the outboard motor. As a result of this sudden failure, overheating can cause sudden seizure of the engine. Such seizures can occur without prior warning mainly because marine engines operate under substantially constant and high load conditions and at a position in the boat where they are not under constant observation. As a result, any stoppage of the water supply may cause seizure of the engine by overheating before the operator realises that the water supply has been stopped.

Furthermore, the coolant flow passages in marine engines are subject to harsh salt water operating conditions and thus they may gradually become blocked internally by build-up of scale. This can also cause overheating and result in damage to the engine. Also, large marine engines rely on an oil circulating system to maintain them at the optimum operating condition and failure of same can likewise cause severe damage to the engine.

It is thus an object of this invention to provide safety apparatus which will prevent an engine operating when the coolant supply or oil supply to the engine has been either substantially reduced or completely stopped. Preferably, the safety apparatus will give adequate warning of a fault in the engine so that the operator can make the correct decision as regards the operation of the engine under the prevailing conditions. Other objects and advantages of the invention will become apparent from the following description.

With the foregoing and other objects in view, this invention resides broadly in monitoring and control apparatus for an engine, including an engine monitoring assembly operatively connectible to the engine to monitor the condition of the engine coolant and/or the lubricating oil of the engine and adapted to be actuated to transmit a signal to a control assembly upon detecting an abnormal condition of said coolant and/or said lubricating oil, and said control assembly being operatively connectible to speed control means of the engine and operable upon receiving said signal to actuate said speed control means to reduce the speed of the engine.

In order that the invention may be more readily understood and put into practical effect, reference will now be made to the accompanying drawings which illustrate various features of the invention, and wherein:

FIGS. 7, 8 and 9 illustrate the electrical connections of the apparatus of the invention to a two-cylinder, manual start magneto ignition electric start engine and an electric start diesel engine respectively.

Figure 1:
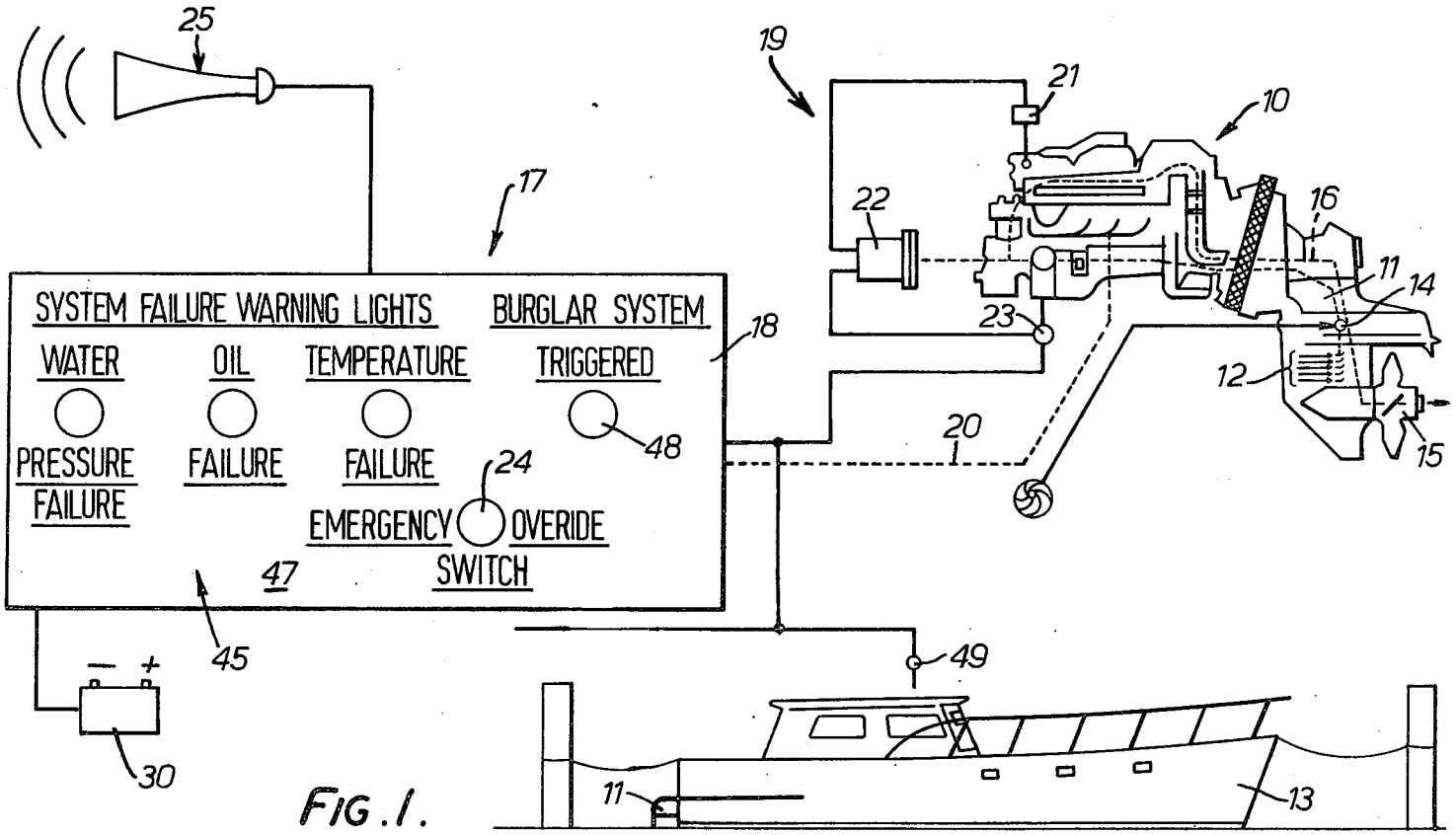
FIG. 1 is a schematic illustration of an installation of the apparatus of the invention in a boat.

In FIG. 1 there is shown a water-cooled marine engine 10 for a boat 13. In the illustrated embodiment the engine 10 drives through an outboard leg 11 having a water inlet assembly 12 through which water passes to a vane-pump 14 for circulation through the engine 10 and discharged through the propeller hub 15 as indicated by the dotted flow line 16.

The engine 10 in this embodiment is a coil ignition petrol engine which relies for its cooling on the water-coolant flow and on oil circulation in conventional manner. The apparatus 17 according to the invention comprises a control assembly 18 connected to sensors or monitors, generally indicated at 19, for monitoring the operating conditions of the engine 10 and connected also to the ignition system at 20 for control thereof. In this embodiment, the sensors 19 comprise a temperature switch 21, for sensing the temperature of the engine coolant, a water pressure switch 22, for sensing the operational pressure of the circulating coolant and an oil pressure switch 23, for sensing the oil pressure within the engine 10.

The control assembly 18 is adapted to be actuated by the operating condition sensors 19 of the engine and in broad concept, when one condition becomes abnormal the ignition system is made inactive so that the engine will stop. However, in a high-speed boat it would be dangerous to stop the engine without warning as the sudden deceleration could cause unprepared occupants of the boat to be thrown about, even overboard. Also, if the boat was, say, traversing a bar at the time of the abnormal operating condition, it would be unwise to stop the engine where the boat would be in danger of founding due to its uncontrollable condition in rough seas.

Accordingly, this invention provides in the control assembly 18 an override switch 24 which can be actuated to override the abnormality if it will not result in immediate seizure of the engine, in which case further operation would be pointless. As well as this, there is provided a time delay and an audible alarm 25 which sounds for eight seconds prior to the ignition system being made inactive. This eight second time delay gives the occupants time to take up secure positions in the boat or to operate the override switch so as to enable them to continue to pass through a dangerous sea for example, or to slowly throttle-back the engine to avoid the sudden deceleration which would result if the ignition was made inactive when the engine was operating at high speeds.

As shown in FIG. 8, the control assembly 18 includes a pair of relay operated contacts, one normally open contact 27 and one normally closed contact 26. The normally open contact 27 is connected between the points 28 of the distributor while the normally closed contact 26 is connected between the coil 29 and the battery 30. The contacts 26 and 27 are adapted to be actuated when a sensor advises the control assembly 18 of an operating abnormality whereupon the audible alarm will sound and an eight second countdown will begin prior to the actuation of the contacts 26 and 27. Once these are actuated the points are shorted out and the coil is isolated from the battery 30 to cause the engine to stop.

The pressure switch 22, the sensor for the coolant flow, is in the form of a diaphragm-operated microswitch assembly 31 illustrated in detail in FIGS. 2 and 3 and hereinafter described. In use, the diaphragm 32 of the water pressure switch 22 is adapted to communicate with the coolant flow so that provided the pressure remains at or above an acceptable level the contacts of the microswitch 31 are maintained closed. Once the coolant pressure falls below a preselected level, the return spring 33 of the diaphragm 32 overcomes the flow pressure and moves the diaphragm so that the contacts of the microswitch 31 are opened. This change in condition in the form of a step function signal is relayed to the control assembly 18 which is activated.

The water pressure switch 22 may be actuated by reason of say a plastic bag covering the inlet 12 or, say, by the water passages of the engine deteriorating to such an extent that flow is restricted sufficiently to cause the diaphragm 32 to release the microswitch 31. In the latter case, even though the control assembly 18 may be activated it would still be feasible to operate the engine. For this purpose, the override switch 24 is provided and the engine can be operated normally once this switch has been depressed to isolate the water pressure sensing circuit. The engine 10 will then continue to operate until its operating temperature reaches a level at which it is dangerous to continue operating the engine. This temperature is sensed by the temperature switch 21 and once the preselected temperature has been reached, even though the water pressure circuit has been isolated, the alarm will sound and the eight second countdown will begin prior to inactivation of the ignition. If during the eight second countdown the emergency switch 24 is again depressed and held down, the safety system will be completely isolated and the engine will be operating unprotected. The oil pressure switch 23 may actuate the control assembly 18 in a manner similar to the temperature switch 21.

As the control assembly 18 is adapted to inactivate the ignition 20 when the pressure of the coolant flow is low it is necessary to provide an override for starting purposes, and for operating conditions when the engine is idling. At such times, the water coolant pressure is very low and severe damage will not be caused to the engine if the coolant flow system is operating abnormally. For this purpose, as shown in FIG. 8, there is provided an override sensing lead 35 connected about one ignition lead 34 and adapted to count the ignition pulses so that below a preselected value, the control assembly is inactivated. This allows for starting and for idling conditions.

Figure 5:
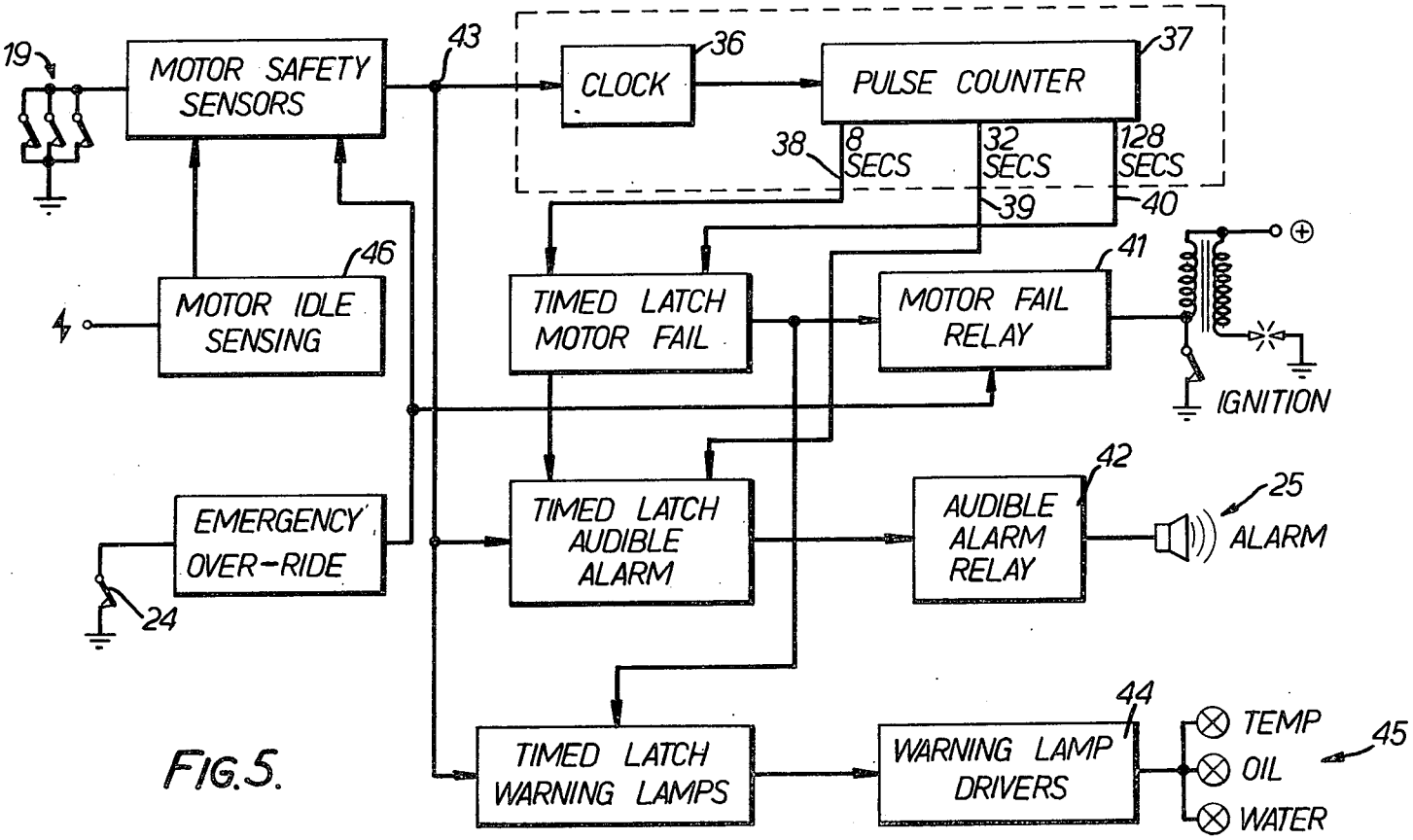
FIG. 5 is a block diagram illustrating the arrangement of the basic monitoring and control apparatus of the invention.

Referring to the block diagram of FIG. 5, there is shown the general arrangement of the apparatus according to the invention. In the operation of this system if an engine sensor 19 is switched it transmits the information to a clock 36 connected operatively to a binary-counter 37 having outputs 38, 39 and 40 at 8 seconds, 32 seconds and 128 seconds respectively. The output 28 actuates the engine fail relay 41 comprising the relays 26 and 27 together with the audible alarm relay 42, the latter also being connected directly to the sensors 19 at 43 for commencement of operation directly upon the fault being sensed. Also, at the same time, the respective drivers 44 for the warning lamps 45 are actuated to give a visual indication of which function is operating abnormally. Also shown is the idling sensing switch 46 and the emergency override switch 24. It will be seen that the emergency override switch 24 co-operates with the engine safety senses 19 and the engine fail relay 41 in order to isolate the safety system if actuated.

Figure 6:
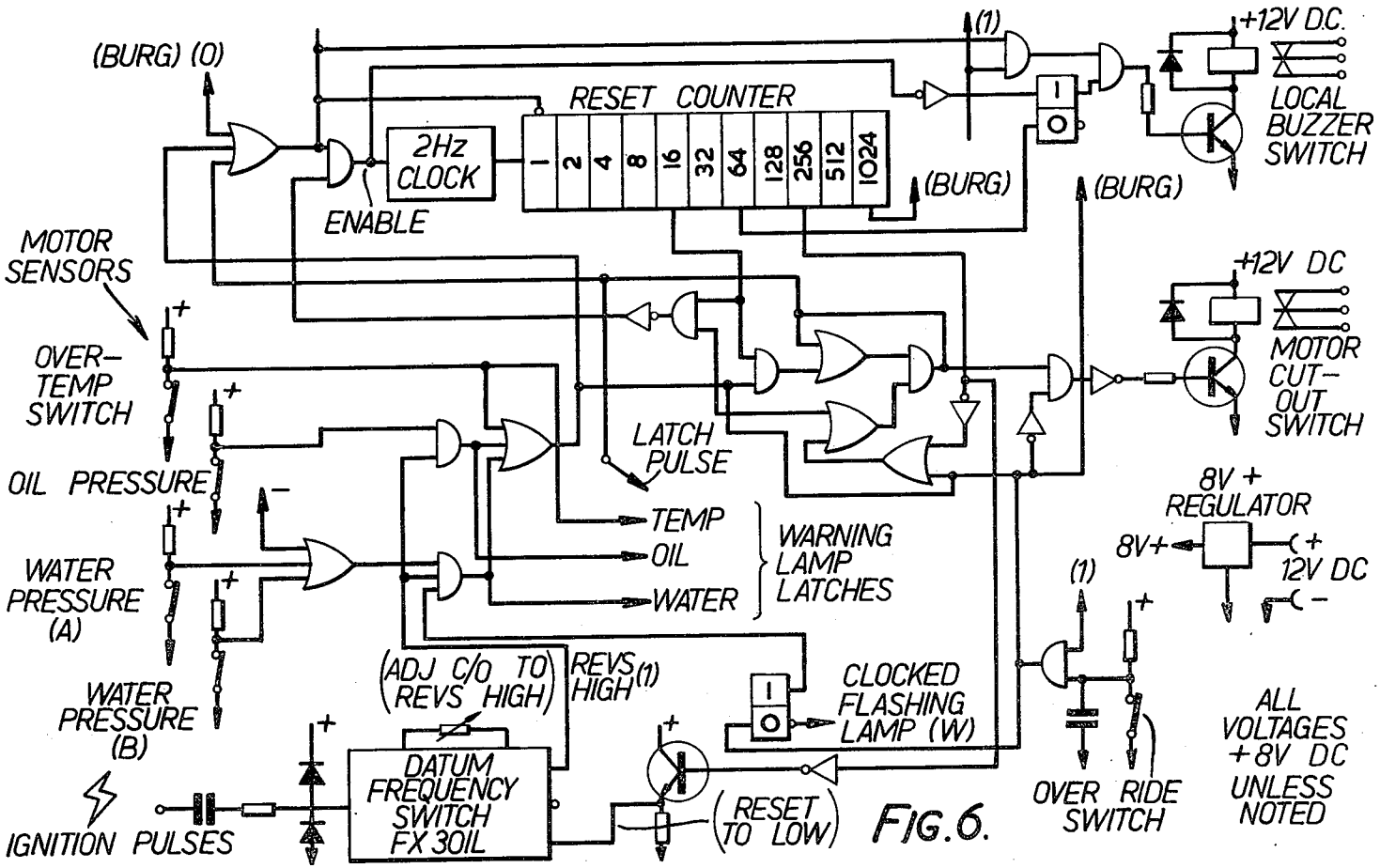
FIG. 6 shows the basic circuit of the apparatus according to the present invention.

FIG. 6 illustrates in more detail the actual configuration of the electrical components of the switch arrangement according to the present invention. It will be seen that the arrangement is such that if the override switch is depressed then the water pressure fail system is isolated. However, if the temperature switch is activated the override switch must be depressed and held down in order to maintain the temperature switch in an isolated condition and immediately upon release of the switch the ignition circuit will be activated and the engine stopped. As shown in FIG. 5, the 32 second output 39 is connected to the audible alarm relay to terminate the audible alarm, that is, the audible alarm will commence immediately upon the fault being sensed and will continue for 32 seconds. The 128 second output 40 is connected to the engine fail relay 41 so that the relay is switched back to normal condition after 128 seconds. If the fault has been rectified in the meantime, the engine will be able to be restarted and will operate normally.

It will be seen that the control panel 47 incorporates a light 48 to indicate that the burglar system inbuilt in the system has been triggered. In the preferred embodiment, once the master key switch 49 for the burglar system has been actuated the burglar system co-operates with the safety device so that if, say, a thief attempted to start the engine by shorting out the switch 49, the alarm 25 would sound. Furthermore, if the thief managed to short the ignition lead to start the engine the alarm would sound and the engine would operate for only eight seconds when it would stop and remain in the inactive state for a further period of 120 seconds.

FIGS. 7 and 9 illustrate the connection of the system to a two-cylinder manual start magneto ignition engine and an electric start diesel engine respectively. In the magneto ignition engine the sensing lead **35*a* is connected to an ignition lead 34*a* as previously described and the solenoid operating contacts 26*a* and 27*a* are adapted to short the magneto points as illustrated. In the diesel engine the sensing lead 35*b* co-operates with a coil or magnet 50 fixed to the crank shaft or other rotating part of the engine and the contacts 26*b* and 27*b*** are adapted for control of the fuel rack solenoid and the starter-motor, that is, the fuel supply to the engine is stopped and the starter-motor is isolated.

Figure 2:
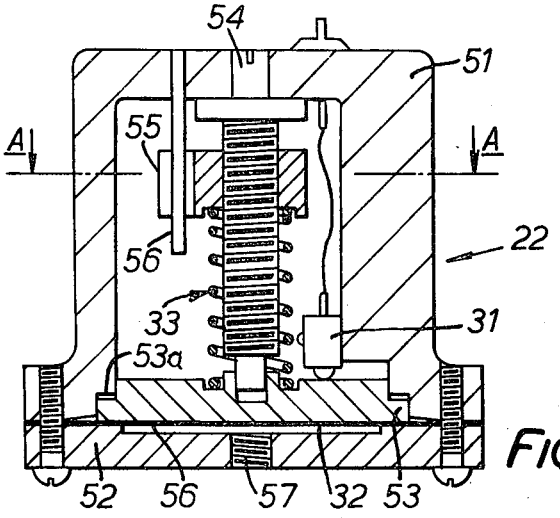
FIG. 2 is a cross-sectional view of a coolant pressure switch for use in the present invention.
Figure 3:
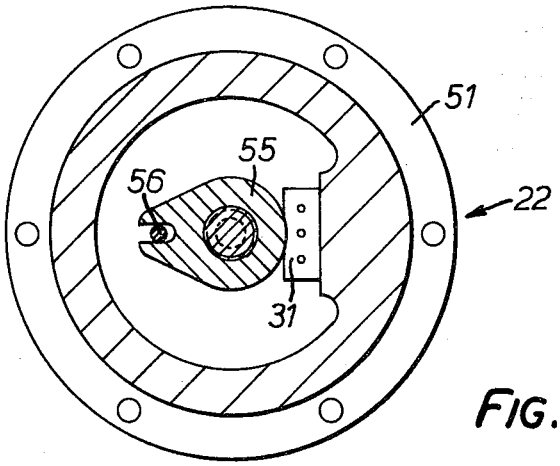
FIG. 3 is a cross-sectional plan view taken along the line A—A of FIG. 2.

The water pressure switch 22 illustrated in FIGS. 2 and 3 comprises an outer housing 51 having an end cap 52 for securing a diaphragm 32 therein. The peripheral flange 53 of the diaphragm base is axially movable in a recess 53*a* in a housing, which recess prevents excessive movement of the diaphragm, just sufficient to actuate the microswitch 31. An axially extending control shaft 54 is provided about which a return spring 33 for the diaphragm is disposed and which is threaded for engagement with a backing plate 55 held non-rotatably by the fixed pin 56 so that as the control shaft 54 is rotated, the backing plate 55 moves axially so as to adjust the tension in the return spring 33. In this manner the spring 33 can be balanced against the water pressure on the front face 56 of the diaphragm which communicates through the inlet 57 with the water coolant of the engine 10.

This adjustment is necessary because, in different brands of outboard motors, the normal operating pressure of the water coolant may vary from one to another, between say 5 and 15 p.s.i. In the engine that operates at a normal pressure of 5 p.s.i. the pressure switch 22 has to be set so that the microswitch 29 will not be opened until the pressure falls below a very low value or say one and one-half to two pounds per square inch. In the case of an outboard engine normal operating at a high pressure of 15 p.s.i. the lower threshold will have to be increased and this is done by adjusting the control shaft 54.

Figure 4:
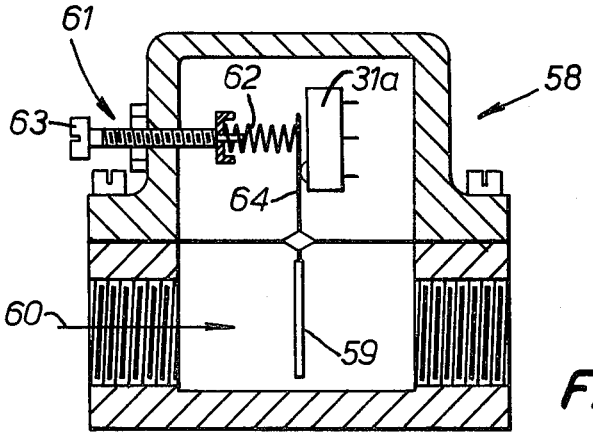
FIG. 4 is a cross-sectional view of a coolant flow switch for use in lieu of the pressure switch illustrated in FIGS. 2 and 3.

FIG. 4 illustrates a flow switch 58 which may be used in lieu of the pressure switch 22. However, it would normally be necessary that the engine be provided with suitable connections to enable the flow switch to be connected into the water coolant flow. In this embodiment a paddle 59 is connected in the flow stream indicated by the arrow 60 and co-operates with a microswitch 31*a*. The adjustment means 61 in this embodiment comprise a spring 62 and adjustment bolts 63 which may be rotated to increase the effect of the spring 22 against the lever end 64 of the battery 59.

The above described solid state control assembly may of course be replaced by mechanical control means. In a simplified form of the invention there is provided a mechanical switch connected operatively to the throttle and adapted to isolate the safety device when the throttle is in the start and idling position. In the above described embodiment, the safety apparatus has been arranged to stop the engine. However, the engine function controlled could be the throttle whereby when a malfunction is sensed, the speed of the engine is reduced to say idling speed.

It will of course be realised that many modifications of constructional detail and design may be made to the above described embodiments by persons skilled in the art without departing from the broad scope and ambit of the invention as is defined by the appended claims.

I claim:

1. Monitoring and control apparatus in combination with a marine engine including:

a. flow detection means for monitoring the engine's coolant flow;

b. temperature detecting means for monitoring the engine temperature;

c. signal means associated with said flow detecting means and said temperature detecting means and adapted to transmit a signal upon detecting an abnormal operating condition of said coolant flow or said temperature;

d. alarm means associated with said signal means and activated upon receipt of a signal for said signal means;

e. automatic engine speed control assembly for reducing the speed of said marine engine upon receiving an operative signal from said signal means;

f. time delay means interposed between said signal means and said speed control assembly and arranged so that an operative signal will not be transmitted to said speed control assembly until said abnormal operating condition continues for a predetermined period of time, and g. manually operable override means operable to prevent actuation of said speed control assembly upon existence of said abnormal operating condition for a period longer than said predetermined period of time.

2. Monitoring and control apparatus according to claim 1 wherein said over-ride means is operable in a first mode of operation to prevent actuation of said speed control assembly due to abnormally low coolant flow and operable in a subsequent mode of operation to prevent actuation of said speed control assembly due to abnormally high engine temperature.

3. Monitoring and control apparatus according to claim 1, wherein said over-ride means is operable in said first mode by depressing and releasing a press button switch and is operable in said subsequent mode of operation by depressing and maintaining a press button switch in its depressed attitude.

4. Monitoring and control apparatus according to claim 3, wherein the time delay between the actuation of said alarm means and said speed control means is in the range of five to thirty seconds.

5. Monitoring and control apparatus according to claim 2, wherein said control assembly is operable to reduce the speed of the engine to zero.

6. Monitoring and control apparatus according to claim 3, wherein said flow sensitive device comprises a pressure switch adapted to be operatively connected into the coolant flow passage of said engine.

7. Monitoring and control apparatus according to claim 2, wherein said control assembly is an assembly of electrical components in the form of a logic circuit operatively connected to actuate a solenoid assembly for operating said speed control means and wherein said control assembly includes a clock and a counter adapted to count pulses from said clock and to provide time spaced signals for controlling said speed control means, said clock and binary counter constituting said time delay means.

8. Monitoring and control apparatus according to claim 7, wherein said counter provides a first output time-spaced from the signal from said sensing assembly for actuation of said speed control means and a second output time-spaced from said first output for deactivating said control assembly.

9. Monitoring and control apparatus according to claim 5, wherein said engine is an internal-combustion engine and said speed control means comprises the electrical system of the engine.

10. Monitoring and control apparatus according to claim 6, wherein said pressure switch includes a housing and a diaphragm dividing said housing into a first sealed chamber adapted to communicate with the engine coolant and a second chamber in which there is supported a microswitch operatively positioned for actuation by movement of said diaphragm and spring return means associated with said diaphragm to counteract the coolant pressure and said spring return means being selectively adjustable to enable said pressure switch to be adjusted for switching at a preselected coolant pressure.

11. Monitoring and control apparatus according to claim 2, wherein said coolant flow sensitive device is in the form of a flow switch adapted to be operatively disposed in the coolant for actuation by same.

* * * * *

UNITED STATES PATENT AND TRADEMARK OFFICE

CERTIFICATE OF CORRECTION

PATENT NO. : 4,019,489

DATED : April 26, 1977

INVENTOR(S) : George Bowen Cartmill

It is certified that error appears in the above-identified patent and that said Letters Patent are hereby corrected as shown below:

Column 4, line 8, "28" should read --38--.

Column 6, line 2 of claim 3, "claim 1" should read --claim 2--.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*